US007861692B2

(12) United States Patent
Biasci et al.

(10) Patent No.: US 7,861,692 B2
(45) Date of Patent: Jan. 4, 2011

(54) COUPLING ARRANGEMENT

(75) Inventors: Enio Biasci, Campo (IT); Edoardo Giorgetti, Rosignano Marittimo (IT); Daniel Marc, Livorno (IT); Giandomenico Serra, Pisa (IT)

(73) Assignee: Continental Automotive GmbH, Hannover (DE)

( * ) Notice: Subject to any disclaimer, the term of this patent is extended or adjusted under 35 U.S.C. 154(b) by 140 days.

(21) Appl. No.: 12/402,280

(22) Filed: Mar. 11, 2009

(65) Prior Publication Data

US 2009/0235899 A1 Sep. 24, 2009

(30) Foreign Application Priority Data

Mar. 19, 2008 (EP) ..... 08005225

(51) Int. Cl.
*F02M 61/14* (2006.01)
*F02M 61/18* (2006.01)

(52) U.S. Cl. ..... 123/470; 123/456

(58) Field of Classification Search ..... 123/470, 123/456, 468, 469; 239/600; 285/281, 365
See application file for complete search history.

(56) References Cited

U.S. PATENT DOCUMENTS

| | | | | |
|---|---|---|---|---|
| 4,982,983 | A | 1/1991 | Bortolotti | |
| 6,539,920 | B1 * | 4/2003 | Spiers | 123/456 |
| 2009/0173317 | A1 * | 7/2009 | Doherty et al. | 123/470 |

* cited by examiner

*Primary Examiner*—Mahmoud Gimie
(74) *Attorney, Agent, or Firm*—King & Spalding L.L.P.

(57) ABSTRACT

A coupling arrangement has a fuel injector cup with a central longitudinal axis coupled to a fuel rail at a first axial end area and to a ring element at a second axial end area by a circlip. The cup has at least two slots arranged at the second end area and at least two grooves arranged at least partly circumferentially the cup and axially overlapping with the slots. The ring element is arranged at the central longitudinal axis facing the second end area and coupled to a housing. The ring element has at least two protrusions facing the cup having at least two grooves arranged at least partly circumferentially the ring element in a common plane with the grooves. The circlip is arranged at least partly circumferentially the cup at least partly in the grooves and arranged at least partly circumferentially the ring element at least partly in the grooves.

17 Claims, 3 Drawing Sheets

COUPLING ARRANGEMENT

CROSS-REFERENCE TO RELATED APPLICATIONS

This Application claims priority to European Patent Application No. EP08005225 filed Mar. 19, 2008. The complete disclosure of the above-identified application is hereby fully incorporated herein by reference.

TECHNICAL FIELD

The invention relates to a coupling arrangement for coupling a fuel injector to a fuel rail of a combustion engine.

BACKGROUND

Coupling arrangements for hydraulically and mechanically coupling a fuel injector to a fuel rail are in widespread use, in particular for internal combustion engines. Fuel can be supplied to an internal combustion engine by the fuel rail assembly through the fuel injector. The fuel injectors can be coupled to the fuel injector cups in different manners.

In order to keep pressure fluctuations during the operation of the internal combustion engine at a very low level, internal combustion engines are supplied with a fuel accumulator to which the fuel injectors are connected and which has a relatively large volume. Such a fuel accumulator is often referred to as a common rail.

Known fuel rails comprise a hollow body with recesses in form of fuel injector cups, wherein the fuel injectors are arranged. The connection of the fuel injectors to the fuel injector cups that supply the fuel from a fuel tank via a low or high-pressure fuel pump needs to be very precise to get a correct injection angle and a sealing of the fuel.

SUMMARY

According to various embodiments, a coupling arrangement for coupling a fuel injector to a fuel rail can be created which is simply to be manufactured and which facilitates a reliable and precise connection between the fuel injector and the fuel injector cup without a resting of the fuel injector on the cylinder head.

According to an embodiment, a coupling arrangement for coupling a fuel injector to a fuel rail of a combustion engine, may comprise:—a fuel injector cup having a central longitudinal axis and being designed to be coupled to the fuel rail at a first axial end area and to a ring element at a second axial end area by a circlip, wherein the fuel injector cup comprises at least two slots being arranged at the second axial end area and at least two grooves of the fuel injector cup being arranged at least partly circumferentially the fuel injector cup and axially overlapping with the slots,—the ring element being arranged at the central longitudinal axis facing the second axial end area of the fuel injector cup and being coupled to a housing of the fuel injector, wherein the ring element comprises at least two protrusions facing the fuel injector cup and the protrusions comprise at least two grooves of the ring element being arranged at least partly circumferentially the ring element in a common plane with the grooves of the fuel injector cup, and—the circlip being arranged at least partly circumferentially the fuel injector cup at least partly in the grooves of the fuel injector cup and being arranged at least partly circumferentially the ring element at least partly in the grooves of the ring element.

According to a further embodiment, the fuel injector cup may comprise a larger outer diameter at the second axial end area of the fuel injector cup than at the first axial end area. According to a further embodiment, a cross section of the circlip may be at least partly circular shaped and cross sections of the grooves of the fuel injector cup and of the grooves of the ring element may be at least partly reference circle-shaped to at least partly take in the circlip. According to a further embodiment, the cross section of the circlip may be at least partly rectangular shaped and the cross sections of the grooves of the fuel injector cup and of the grooves of the ring element may be at least partly shaped as a part of a rectangle to at least partly take in the circlip. According to a further embodiment, at least one of the ring element and the fuel injector cup may be arranged at least partly circumferentially the housing of the fuel injector. According to a further embodiment, the ring element may be coupled by a snap ring to the housing of the fuel injector, the ring element, the housing of the fuel injector and the snap ring being designed and arranged such as to prevent a movement of the housing of the fuel injector relative to the ring element at least in one direction of the central longitudinal axis. According to a further embodiment, the housing of the fuel injector may comprise a groove of the housing designed to at least partly take in the snap ring. According to a further embodiment, the ring element may comprise an inner groove of the ring element designed to at least partly take in the snap ring. According to a further embodiment, the ring element may comprise a larger inner diameter at a first axial end area facing the fuel injector cup than at a second axial end area facing away from the fuel injector cup. According to a further embodiment, the housing of the fuel injector may comprise a larger outer diameter at a first axial end area facing the fuel injector cup than at a second axial end area facing away from the fuel injector cup. According to a further embodiment, the ring element may comprise a smaller inner diameter at the first axial end area facing the fuel injector cup than at the second axial end area facing away from the fuel injector cup. According to a further embodiment, the housing of the fuel injector may comprise a smaller outer diameter at the first axial end area facing the fuel injector cup than at the second axial end area facing away from the fuel injector cup. According to a further embodiment, the slots of the fuel injector cup and the protrusions of the ring element may be arranged such that the distances circumferentially the fuel injector cup between at least two of the slots and the distances circumferentially the ring element between at least two of the protrusions are different.

BRIEF DESCRIPTION OF THE DRAWINGS

Exemplary embodiments are explained in the following with the aid of schematic drawings. These are as follows.

Elements of the same design and function that occur in different illustrations are identified by the same reference character.

DETAILED DESCRIPTION

Figure 1:
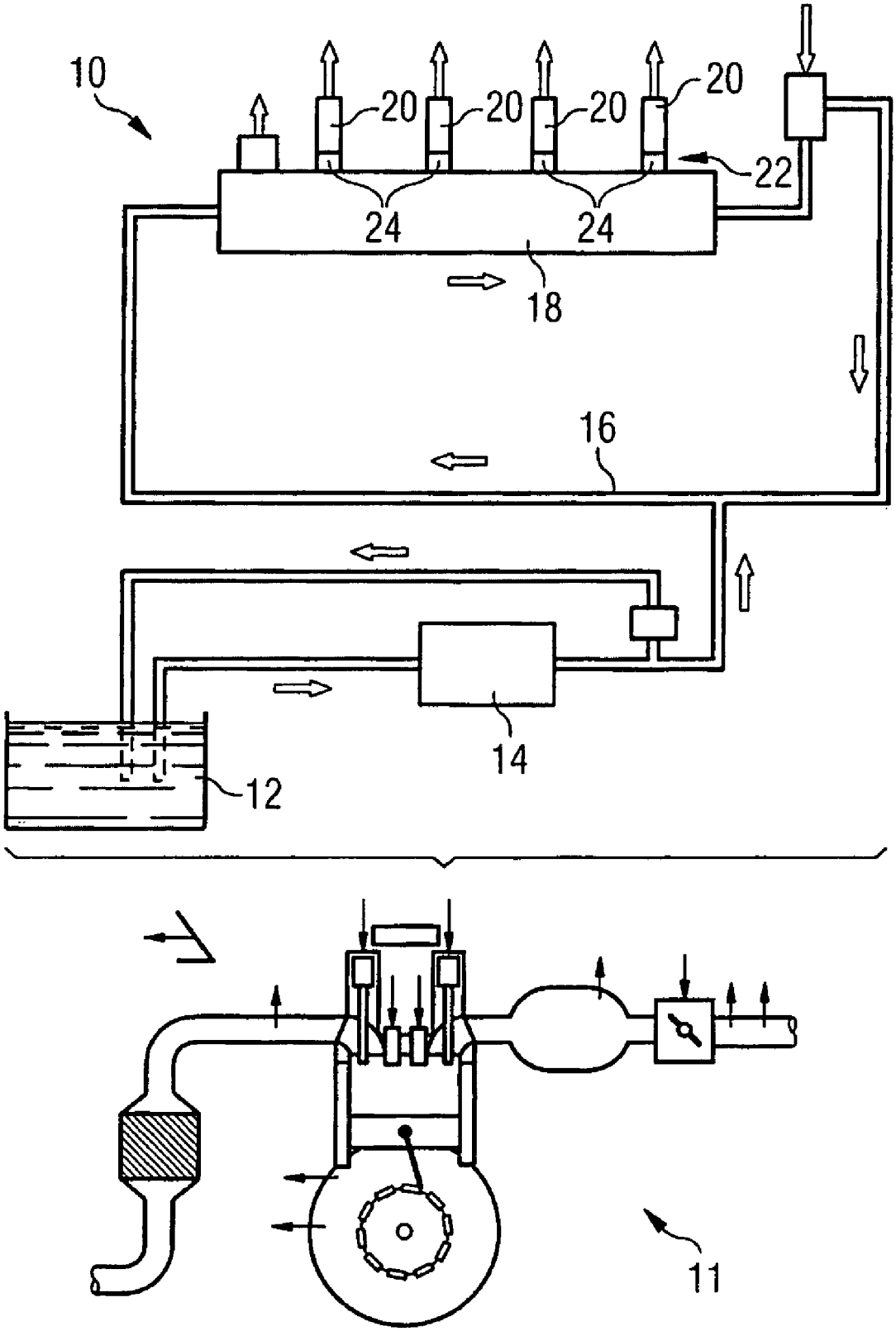
FIG. 1 an internal combustion engine in a schematic view.

According to various embodiments, a coupling arrangement for coupling a fuel injector to a fuel rail of a combustion engine, may comprise a fuel injector cup having a central longitudinal axis and being designed to be coupled to the fuel rail at a first axial end area and to a ring element at a second axial end area by a circlip, wherein the fuel injector cup comprises at least two slots being arranged at the second axial end area and at least two grooves of the fuel injector cup being arranged at least partly circumferentially the fuel injector cup and axially overlapping with the slots. Furthermore, the coupling arrangement comprises the ring element being arranged at the central longitudinal axis facing the second axial end area of the fuel injector cup and being coupled to a housing of the fuel injector, wherein the ring element comprises at least two protrusions facing the fuel injector cup and the protrusions comprise at least two grooves of the ring element being arranged at least partly circumferentially the ring element in a common plane with the grooves of the fuel injector cup. Furthermore, the coupling arrangement comprises the circlip being arranged at least partly circumferentially the fuel injector cup at least partly in the grooves of the fuel injector cup and being arranged at least partly circumferentially the ring element at least partly in the grooves of the ring element.

This has the advantage that a fast and secure coupling between the fuel injector and the fuel injector cup may be achieved. The coupling arrangement is related for hydraulically and mechanically coupling of the fuel injector to the fuel rail of the combustion engine. The fuel injector cup may be designed for hydraulically coupling it to the fuel rail. The coupling arrangement may resist the high fuel pressures in the fuel injector and the fuel injector cup in a simple way. Furthermore, the coupling of the fuel injector with the fuel rail by the circlip, the ring element and the fuel injector cup allows an assembly of the fuel injector and the fuel rail without a further metallic contact between the fuel injector and further parts of the combustion engine. For example, the fuel injector may be held from its top without resting on the cylinder head. By avoiding a metallic contact to the cylinder head, a transmission of vibrations to the cylinder head may be prevented. Consequently, a noise trans-mission between the fuel injector and further parts of the combustion engine may be kept small. Furthermore, the circlip may be arranged and designed to form a positive locking between the fuel injector cup and the ring element. A movement of the ring element at least in one direction of the central longitudinal axis and a radial movement may be limited. Therefore, a movement of the ring element relative to the fuel injector cup may be prevented to retain the fuel injector in direction of the central longitudinal axis. In particular, the slots of the fuel injector cup and the protrusions of the ring element may comprise corresponding geometries to enable a fixedly coupling between the fuel injector cup and the ring element. Furthermore, such a coupling arrangement may be easy to be manufactured. For instance, the circlip may be made of steel, for example spring steel. In addition, a good accessibility of the circlip may be enabled. In particular, in usual arrangements of fuel injectors a good accessibility from the top of the coupling arrangement may be enabled. To make a rearrangement of the fuel injector possible, the circlip may comprise a gap and ears to open it up and to rearrange the fuel injector.

In an embodiment the fuel injector cup comprises a larger outer diameter at the second axial end area of the fuel injector cup than at the first axial end area.

This has the advantage that a fast and secure coupling between the fuel injector cup and the ring element and therewith the fuel injector may be possible. Furthermore, an especially good accessibility of the circlip from the top of the coupling arrangement may be enabled.

In a further embodiment a cross section of the circlip is at least partly circular shaped and cross sections of the grooves of the fuel injector cup and of the grooves of the ring element are at least partly reference circle-shaped to at least partly take in the circlip.

Therefore, an especially fixedly coupling of the ring element to the fuel injector cup by the circlip may be enabled. In particular, the cross sections of the circlip, the grooves of the fuel injector cup and the grooves of the ring element may comprise corresponding geometries to enable the fixedly coupling between the fuel injector cup and the ring element via the circlip. This may allow a simple construction of the coupling arrangement which enables to carry out a fast and secure but reversible coupling of the ring element to the fuel injector cup.

In a further embodiment the cross section of the circlip is at least partly rectangular shaped and the cross sections of the grooves of the fuel injector cup and of the grooves of the ring element are at least partly shaped as a part of a rectangle to at least partly take in the circlip.

By this, an especially fixedly coupling of the ring element to the fuel injector cup by the circlip may be enabled. In particular, the cross sections of the circlip, the grooves of the fuel injector cup and the grooves of the ring element may comprise corresponding geometries to enable the fixedly coupling between the fuel injector cup and the ring element via the circlip. This may allow a simple construction of the coupling arrangement which enables to carry out a fast and secure but reversible coupling of the ring element to the fuel injector cup.

In a further embodiment the ring element and/or the fuel injector cup are arranged at least partly circumferentially the housing of the fuel injector.

Thus, the fuel injector may be arranged at least partly within the ring element and/or the fuel injector cup. Therefore, a simple and fixedly coupling of the fuel injector via the housing of the fuel injector to the ring element and therewith the fuel injector cup may be enabled.

In a further embodiment the ring element is coupled by a snap ring to the housing of the fuel injector, the ring element, the housing of the fuel injector and the snap ring being designed and arranged such as to prevent a movement of the housing of the fuel injector relative to the ring element at least in one direction of the central longitudinal axis.

The snap ring may be designed to fixedly couple the ring element to the housing of the fuel injector. This has the advantage that a fast and secure coupling between the ring element and the housing of the fuel injector and therewith the fuel injector may be enabled. For example, the fuel injector may be held from its top without resting of the fuel injector on the cylinder head by coupling it to the ring element, which is coupled to the fuel rail via the fuel injector cup. Moreover, the coupling via the snap ring may be simply to be manufactured and facilitates a reliable and precise connection between the fuel injector and the ring element. For example, the coupling between the ring element and the housing of the fuel injector by the snap ring may prevent a movement of the housing of the fuel injector relative to the ring element in both directions of the central longitudinal axis.

In a further embodiment the housing of the fuel injector comprises a groove of the housing designed to at least partly take in the snap ring.

The groove of the housing of the fuel injector may provide additional contact area for the snap ring. The groove of the housing of the fuel injector may prevent the snap ring to be released. Thus, an especially secure coupling between the ring element and the housing of the fuel injector may be enabled. Movement of the housing of the fuel injector relative to the ring element at least in one direction of the central longitudinal axis may be prevented.

In a further embodiment the ring element comprises an inner groove of the ring element designed to at least partly take in the snap ring.

The inner groove of the ring element may provide additional contact area for the snap ring. The inner groove of the ring element may prevent the snap ring to be released. Thus, an especially secure coupling between the ring element and the housing of the fuel injector may be enabled. For example, the housing of the fuel injector may comprise the groove of the housing and the ring element may comprise the inner groove of the ring element both designed to at least partly take in the snap ring. Therefore, movement of the housing of the fuel injector relative to the ring element for example in both directions of the central longitudinal axis may be prevented.

In a further embodiment the ring element comprises a larger inner diameter at a first axial end area facing the fuel injector cup than at a second axial end area facing away from the fuel injector cup.

By this, additional contact area for the snap ring may be provided. For example, movement of the ring element relative to the housing of the fuel injector at least in the direction of the central longitudinal axis facing the fuel injector cup may be prevented. The larger inner diameter of the ring element at the first axial end area facing the fuel injector cup compared to the second axial end area may prevent the snap ring to be released. An especially fixedly coupling between the ring element and the housing of the fuel injector via the snap ring may be enabled. Moreover, a simple manufacturing may be possible. For example, the housing of the fuel injector may comprise the groove of the housing and the ring element may comprise the larger inner diameter at the first axial end area facing the fuel injector cup than at the second axial end area. Therefore, an especially secure coupling between the ring element and the housing of the fuel injector by the snap ring may be enabled.

In a further embodiment the housing of the fuel injector comprises a larger outer diameter at a first axial end area facing the fuel injector cup than at a second axial end area facing away from the fuel injector cup.

This has the advantage that additional contact area for the snap ring may be provided. For example, movement of the housing of the fuel injector relative to the ring element at least in the direction of the central longitudinal axis facing away from the fuel injector cup may be prevented. The larger outer diameter of the housing of the fuel injector at the first axial end area facing the fuel injector cup compared to the second axial end area may prevent the snap ring to be released. An especially fixedly coupling between the housing of the fuel injector and the ring element via the snap ring may be enabled. Moreover, a simple manufacturing may be possible. For example, the ring element may comprise a larger inner diameter at the first axial end area facing the fuel injector cup than at the second axial end area and the housing of the fuel injector may comprise the larger outer diameter at the first axial end area facing the fuel injector cup than at the second axial end area. Therefore, an especially secure coupling between the ring element and the housing of the fuel injector by the snap ring may be enabled.

In a further embodiment the ring element comprises a smaller inner diameter at the first axial end area facing the fuel injector cup than at the second axial end area facing away from the fuel injector cup.

By this, additional contact area for the snap ring may be provided. For example, movement of the ring element relative to the housing of the fuel injector at least in one direction of the central longitudinal axis may be prevented. The smaller inner diameter of the ring element at the first axial end area facing the fuel injector cup compared to the second axial end area may prevent the snap ring to be released. For example, the housing of the fuel injector may comprise the groove of the housing and the ring element may comprise the inner groove of the ring element and the smaller inner diameter at the first axial end area facing the fuel injector cup than at the second axial end area. Therefore, an especially fixedly coupling between the ring element and the housing of the fuel injector via the snap ring may be enabled. Moreover, a simple manufacturing may be possible.

In a further embodiment the housing of the fuel injector comprises a smaller outer diameter at the first axial end area facing the fuel injector cup than at the second axial end area facing away from the fuel injector cup.

This has the advantage that additional contact area for the snap ring may be provided. For example, movement of the housing of the fuel injector relative to the ring element at least in one direction of the central longitudinal axis may be prevented. The smaller outer diameter of the housing of the fuel injector at the first axial end area facing the fuel injector cup compared to the second axial end area may prevent the snap ring to be released. For example, the ring element may comprise the inner groove of the ring element and the housing of the fuel injector may comprise the groove of the housing and the smaller outer diameter at the first axial end area facing the fuel injector cup than at the second axial end area. Therefore, an especially fixedly coupling between the ring element and the housing of the fuel injector via the snap ring may be enabled. Moreover, a simple manufacturing may be possible.

In a further embodiment the slots of the fuel injector cup and the protrusions of the ring element are arranged such that the distances circumferentially the fuel injector cup between at least two of the slots and the distances circumferentially the ring element between at least two of the protrusions are different.

Therefore, an asymmetric pattern of the slots of the fuel injector cup and the protrusions of the ring element may be provided. Thus, an angular position indexing of the fuel injector may be enabled. In particular, the slots of the fuel injector cup and the protrusions of the ring element comprise corresponding geometries to enable an especially secure coupling between the fuel injector cup and the ring element. Thus, a defined angular positioning of the fuel injector relative to the fuel injector cup may be enabled.

A fuel feed device 10 is assigned to an internal combustion engine 11 (FIG. 1) which can be a diesel engine or a gasoline engine. It includes a fuel tank 12 that is connected via a first fuel line to a fuel pump 14. The output of the fuel pump 14 is connected to a fuel inlet 16 of a fuel rail 18. In the fuel rail 18, the fuel is stored for example under a pressure of about 200 bar in the case of a gasoline engine or of about 2,000 bar in the case of a diesel engine. Fuel injectors 20 are coupled to the fuel rail 18 and the fuel is fed to the fuel injectors 20 via the fuel rail 18. Coupling arrangements 22 for coupling the fuel injectors 20 to the fuel rail 18 of the combustion engine 11 comprise a fuel injector cup 24.

Figure 2:
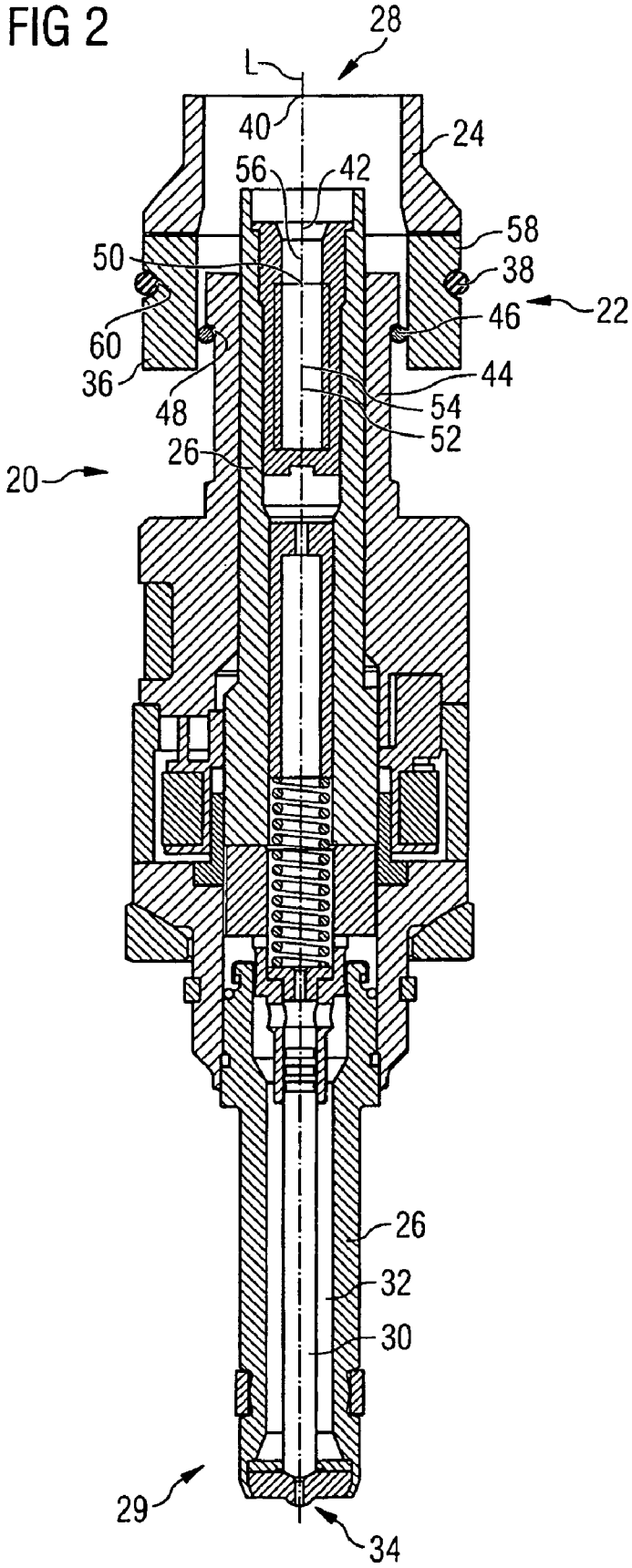
FIG. 2 a longitudinal section through a fuel injector with a first embodiment of a coupling arrangement, FIG. 3 a longitudinal section through a second embodiment of the coupling arrangement, FIG. 4 the coupling arrangement along the line I-I' of FIG. 3 in a section view, FIG. 5 a three-dimensional view of a fuel injector cup, and FIG. 6 a three-dimensional view of a ring element.

FIG. 2 shows an exemplary embodiment of the fuel injector 20. The fuel injector 20 has a fuel injector body 26 and is suitable for injecting fuel into a combustion chamber of the internal combustion engine 11. The fuel injector 20 has a fuel inlet portion 28 and a fuel outlet portion 29.

Furthermore, the fuel injector 20 comprises a valve needle 30 taken in a cavity 32 of the fuel injector body 26. On a free end of the fuel injector 20 an injection nozzle 34 is formed which is closed or opened by an axial movement of the valve needle 30. In a closing position a fuel flow through the injection nozzle 34 is prevented. In an opening position fuel can flow through the injection nozzle 34 into the combustion chamber of the internal combustion engine 11.

Moreover, FIG. 2 shows a first embodiment of the coupling arrangement 22 for coupling the fuel injector 20 to the fuel rail 18. The coupling arrangement 22 comprises the fuel injector cup 24, a ring element 36 and a circlip 38. The fuel injector cup 24 has a central longitudinal axis L and is designed to be coupled to the fuel rail 18 at a first axial end area 40 and to the ring element 36 at a second axial end area 42 by the circlip 38. The fuel injector cup 24 comprises a larger outer diameter at the second axial end area 42 of the fuel injector cup 24 than at the first axial end area 40.

The ring element 36 is arranged at the central longitudinal axis L facing the second axial end area 42 of the fuel injector cup 24. The ring element 36 is arranged at least partly circumferentially a housing 44 of the fuel injector 20. The ring element 36 is coupled to the housing 44 of the fuel injector 20 by a snap ring 46. The housing 44 of the fuel injector 20 comprises a groove 48 of the housing 44 designed to at least partly take in the snap ring 46. Moreover, the housing 44 of the fuel injector 20 comprises a larger outer diameter at a first axial end area 50 facing the fuel injector cup 24 than at a second axial end area 52 facing away from the fuel injector cup 24 facing a second axial end area 54 of the ring element 36. The ring element 36 comprises a larger inner diameter at a first axial end area 56 facing the fuel injector cup 24 than at the second axial end area 54 facing away from the fuel injector cup 24.

In a further exemplary embodiment, the ring element 36 may comprise a smaller inner diameter at the first axial end area 56 facing the fuel injector cup 24 than at the second axial end area 54 facing away from the fuel injector cup 24. For instance, the housing 44 of the fuel injector 20 may comprise a smaller outer diameter at the first axial end area 50 facing the fuel injector cup 24 than at the second axial end area 52 facing away from the fuel injector cup 24 facing the second axial end area 54 of the ring element 36.

The ring element 36, the housing 44 of the fuel injector 20 and the snap ring 46 are designed and arranged such as to prevent a movement of the housing 44 of the fuel injector 20 relative to the ring element 36 at least in one direction of the central longitudinal axis L, for example in both directions of the central longitudinal axis L.

Moreover, the ring element 36 comprises at least two protrusions 58 facing the fuel injector cup 24. The at least two protrusions 58 of the ring element 36 are arranged in at least two slots 66 (FIG. 5) of the fuel injector cup 24 to enable a fixedly coupling between the ring element 36 and the fuel injector cup 24. The protrusions 58 of the ring element 36 comprise at least two grooves 60 of the ring element 36 being arranged at least partly circumferentially the ring element 36 in a common plane with at least two grooves 68 (FIG. 5) of the fuel injector cup 24.

For example, the cross section of the circlip 38 is at least partly circular shaped and the cross sections of the grooves 60 of the ring element 36 and of the grooves 68 (FIG. 5) of the fuel injector cup 24 are at least partly reference circle-shaped to at least partly take in the circlip 38.

The coupling of the fuel injector 20 with the fuel rail 18 by the coupling arrangement 22 may enable an assembly of the fuel injector 20 and the fuel injector cup 24 without a further metallic contact between the fuel injector 20 and further parts of the internal combustion engine 11. A sealing between the fuel injector body 26 and a combustion chamber of the internal combustion engine 11 may be carried out by a plastic element, in particular by a PTFE element. Consequently, noise transmission between the fuel injector 20 and further parts of the internal combustion engine may be kept small.

Figure 3:
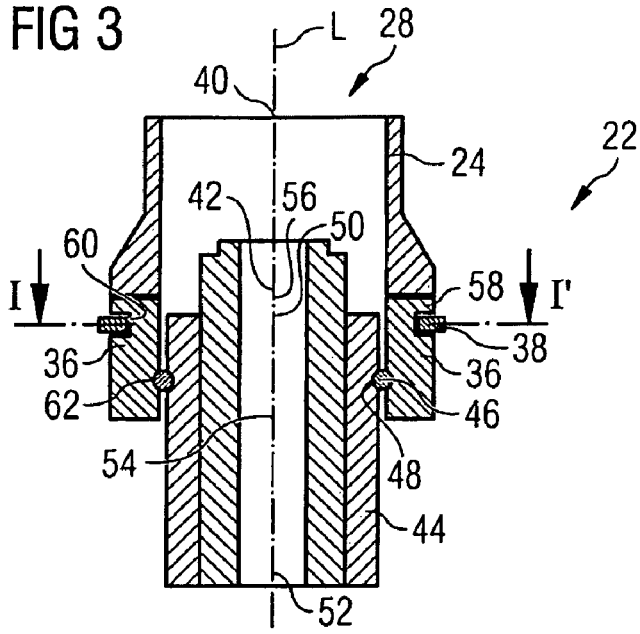

FIG. 3 shows a longitudinal section through a second embodiment of the coupling arrangement 22 for coupling the fuel injector 20 to the fuel rail 18. The fuel injector cup 24 is in engagement with the fuel inlet portion 28 of the fuel injector 20. For example, the fuel inlet portion 28 of the fuel injector 20 may comprise a sealing ring to seal contact with an inner surface of the fuel injector cup 24.

The coupling arrangement 22 comprises the fuel injector cup 24, the ring element 36 and the circlip 38. The fuel injector cup 24 has the central longitudinal axis L and is designed to be coupled to the fuel rail 18 at the first axial end area 40 and to the ring element 36 at the second axial end area 42 by the circlip 38. The fuel injector cup 24 comprises a larger outer diameter at the second axial end area 42 of the fuel injector cup 24 than at the first axial end area 40.

The ring element 36 is arranged at the central longitudinal axis L facing the second axial end area 42 of the fuel injector cup 24. The ring element 36 and the fuel injector cup 24 are arranged at least partly circumferentially the housing 44 of the fuel injector 20. The ring element 36 is coupled to the housing 44 of the fuel injector 20 by the snap ring 46. The housing 44 of the fuel injector 20 comprises the groove 48 of the housing 44 designed to at least partly take in the snap ring 46. The ring element 36 comprises an inner groove 62 of the ring element 36 designed to at least partly take in the snap ring 46. The ring element 36 comprises a larger inner diameter at the first axial end area 56 facing the fuel injector cup 24 than at the second axial end area 54 facing away from the fuel injector cup 24. The ring element 36, the housing 44 of the fuel injector 20 and the snap ring 46 are designed and arranged such as to prevent a movement of the housing 44 of the fuel injector 20 relative to the ring element 36 at least in one direction of the central longitudinal axis L, for example in both directions of the central longitudinal axis L.

Moreover, the ring element 36 comprises the at least two protrusions 58 facing the fuel injector cup 24. The protrusions 58 of the ring element 36 are arranged in the at least two slots 66 (FIG. 5) of the fuel injector cup 24 to enable a fixedly coupling between the ring element 36 and the fuel injector cup 24. The protrusions 58 of the ring element 36 comprise the at least two grooves 60 of the ring element 36 being arranged at least partly circumferentially the ring element 36 in a common plane with the at least two grooves 68 (FIG. 5) of the fuel injector cup 24.

The cross section of the circlip 38 is at least partly rectangular shaped and the cross sections of the grooves 60 of the ring element 36 and of the grooves 68 (FIG. 5) of the fuel injector cup 24 are at least partly shaped as a part of a rectangle to at least partly take in the circlip 38.

As the fuel injector cup 24 is fixedly coupled to the ring element 36 by the circlip 38 and the ring element 36 is fixedly coupled to the housing 44 of the fuel injector 20 by the snap ring 46, the fuel injector 20 is retained in the fuel injector cup 24 in direction of the central longitudinal axis L.

The coupling of the fuel injector 20 with the fuel rail 18 by the coupling arrangement 22 may enable an assembly of the fuel injector 20 and the fuel injector cup 24 without a further metallic contact between the fuel injector 20 and further parts of the internal combustion engine 11.

In the following, the assembly and disassembly of the housing 44 of the fuel injector 20 with the fuel injector cup 24 according to the embodiment of FIG. 3 will be described:

For assembling, the ring element 36 is shifted over the housing 44 of the fuel injector 20 and the snap ring 46 is shifted into the groove 48 of the housing 44 and into the inner groove 62 of the ring element 36. Furthermore, the housing 44 of the fuel injector 20 is engaged into the fuel injector cup 24. The ring element 36 is shifted on the fuel injector cup 24 until the protrusions 58 of the ring element 36 are arranged in the slots 66 (FIG. 5) of the fuel injector cup 24 to enable a fixedly coupling between the fuel injector cup 24 and the ring element 36 and to prevent a movement of the ring element 36 relative to the fuel injector cup 24 at least in one direction of the central longitudinal axis L and to prevent a radial movement. Furthermore, the circlip 38 is inserted at least partly into the grooves 60 of the ring element 36 and into the grooves 68 (FIG. 5) of the fuel injector cup 24 to enable a positive locking between the fuel injector cup 24 and the ring element 36 via the circlip 38 to prevent a movement of the ring element 36 relative to the fuel injector cup 24 in both directions of the central longitudinal axis L.

To disassemble the housing 44 of the fuel injector 20 and therewith the fuel injector 20 from the fuel injector cup 24, the circlip 38 is removed and the housing 44 of the fuel injector 20 can be shifted away from the fuel injector cup 24 in axial direction and the fuel injector cup 24 and the fuel injector 20 can be separated from each other.

Figure 4:
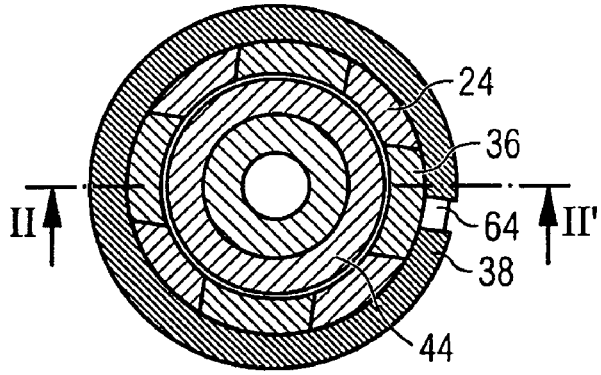

FIG. 4 shows the coupling arrangement 22 along the line I-I' of FIG. 3 in a section view. Circumferentially, the circlip 38 is arranged in the grooves 60 (FIG. 3) of the ring element 36 and in the grooves 68 (FIG. 5) of the fuel injector cup 24. The circlip 38 comprises a gap 64 to enable a rearrangement of the coupling arrangement 22. Moreover, the protrusions 58 of the ring element 36 are arranged in the slots 66 (FIG. 5) of the fuel injector cup 24. For example, four protrusions 58 of the ring element 36 are arranged in four slots 66 (FIG. 5) of the fuel injector cup 24. Furthermore, the ring element 36 and the fuel injector cup 24 are arranged at least partly circumferentially the housing 44 of the fuel injector 20.

Figure 5:
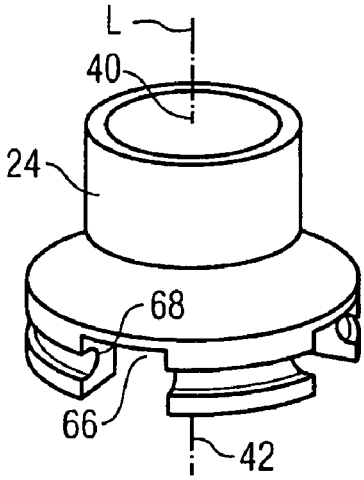

FIG. 5 shows a three-dimensional view of the fuel injector cup 24. The fuel injector cup 24 comprises the central longitudinal axis L and is designed to be coupled to the fuel rail 18 at the first axial end area 40 and to the ring element 36 at the second axial end area 42 by the circlip 38. The fuel injector cup 24 comprises the at least two slots 66 being arranged at the second axial end area 42 and the at least two grooves 68 of the fuel injector cup 24 being arranged at least partly circumferentially the fuel injector cup 24 and axially overlapping with the slots 66. For example, the fuel injector cup 24 comprises four slots 66 and four grooves 68 of the fuel injector cup 24. For example, the cross section of the circlip 38 is at least partly circular shaped and the cross section of the grooves 68 of the fuel injector cup 24 are at least partly reference circle-shaped to at least partly take in the circlip 38.

Figure 6:
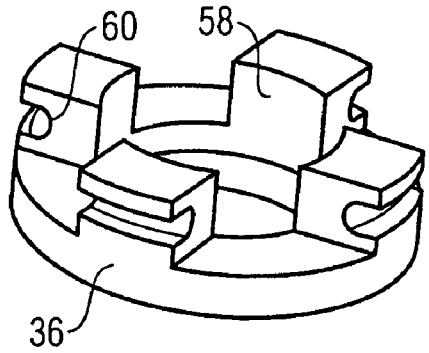

FIG. 6 shows a three-dimensional view of the ring element 36. The ring element 36 comprises the at least two protrusions 58. For example, the ring element 36 comprises four protrusions 58. The protrusions 58 comprise the at least two grooves 60 of the ring element 36 being arranged at least partly circumferentially the ring element 36. For example, the ring element 36 comprises four grooves 60 of the ring element 36. The number of the slots 66 (FIG. 5) of the fuel injector cup 24 corresponds to the number of protrusions 58 of the ring element 36. In particular, the slots 66 of the fuel injector cup 24 and the protrusions 58 of the ring element 36 comprise corresponding geometries to enable a fixedly coupling between the fuel injector cup 24 and the ring element 36. After assembling, the grooves 60 of the protrusions 58 of the ring element 36 are arranged in a common plane with the grooves 68 of the fuel injector cup 24. For example, the cross section of the circlip 38 is at least partly circular shaped and the cross section of the grooves 60 of the ring element 36 are at least partly reference circle-shaped to at least partly take in the circlip 38.

In a further embodiment the slots 66 of the fuel injector cup 24 and the protrusions 58 of the ring element 36 may be arranged such that the distances circumferentially the fuel injector cup 24 between at least two of the slots 66 and the distances circumferentially the ring element 36 between at least two of the protrusions 58 are different. Thus, an asymmetric pattern of the slots 66 of the fuel injector cup 24 and the protrusions 58 of the ring element 36 may be provided both comprising corresponding geometries to enable an especially secure coupling between the fuel injector cup 24 and the ring element 36. Therefore, a defined angular positioning of the ring element 36 and therewith the fuel injector 20 relative to the fuel injector cup 24 may be enabled. Thus, an angular position indexing of the fuel injector 20 may be enabled.

The invention is not restricted to the explained embodiments. For example, the circlip 38, the fuel injector cup 24 and the ring element 36 may comprise alternative shapes. Further, the housing 44 of the fuel injector 20 may comprise alternative shapes.

What is claimed is:

1. A coupling arrangement for coupling a fuel injector to a fuel rail of a combustion engine, the coupling arrangement comprising:

a fuel injector cup having a central longitudinal axis and being designed to be coupled to the fuel rail at a first axial end area and to a ring element at a second axial end area by a circlip, wherein the fuel injector cup comprises at least two slots being arranged at the second axial end area and at least two grooves of the fuel injector cup being arranged at least partly circumferentially the fuel injector cup and axially overlapping with the slots, the ring element being arranged at the central longitudinal axis facing the second axial end area of the fuel injector cup and being coupled to a housing of the fuel injector, wherein the ring element comprises at least two protrusions facing the fuel injector cup and the protrusions comprise at least two grooves of the ring element being arranged at least partly circumferentially the ring element in a common plane with the grooves of the fuel injector cup, and the circlip being arranged at least partly circumferentially the fuel injector cup at least partly in the grooves of the fuel injector cup and being arranged at least partly circumferentially the ring element at least partly in the grooves of the ring element.

2. The coupling arrangement according to claim 1, wherein the fuel injector cup comprises a larger outer diameter at the second axial end area of the fuel injector cup than at the first axial end area.

3. The coupling arrangement according to claim 1, wherein a cross section of the circlip is at least partly circular shaped and cross sections of the grooves of the fuel injector cup and of the grooves of the ring element are at least partly reference circle-shaped to at least partly take in the circlip.

4. The coupling arrangement according to claim 1, wherein the cross section of the circlip is at least partly rectangular shaped and the cross sections of the grooves of the fuel injector cup and of the grooves of the ring element are at least partly shaped as a part of a rectangle to at least partly take in the circlip.

5. The coupling arrangement according to claim 1, wherein at least one of the ring element and the fuel injector cup are arranged at least partly circumferentially the housing of the fuel injector.

6. The coupling arrangement according to claim 1, wherein the ring element is coupled by a snap ring to the housing of the fuel injector, the ring element, the housing of the fuel injector and the snap ring being designed and arranged such as to prevent a movement of the housing of the fuel injector relative to the ring element at least in one direction of the central longitudinal axis.

7. The coupling arrangement according to claim 6, wherein the housing of the fuel injector comprises a groove of the housing designed to at least partly take in the snap ring.

8. The coupling arrangement according to claim 6, wherein the ring element comprises an inner groove of the ring element designed to at least partly take in the snap ring.

9. The coupling arrangement according to claim 6, wherein the ring element comprises a larger inner diameter at a first axial end area facing the fuel injector cup than at a second axial end area facing away from the fuel injector cup.

10. The coupling arrangement according to claim 6, wherein the housing of the fuel injector comprises a larger outer diameter at a first axial end area facing the fuel injector cup than at a second axial end area facing away from the fuel injector cup.

11. The coupling arrangement according to claim 6, wherein the ring element comprises a smaller inner diameter at the first axial end area facing the fuel injector cup than at the second axial end area facing away from the fuel injector cup.

12. The coupling arrangement according to claim 6, wherein the housing of the fuel injector comprises a smaller outer diameter at the first axial end area facing the fuel injector cup than at the second axial end area facing away from the fuel injector cup.

13. The coupling arrangement according to claim 1, wherein the slots of the fuel injector cup and the protrusions of the ring element are arranged such that the distances circumferentially the fuel injector cup between at least two of the slots and the distances circumferentially the ring element between at least two of the protrusions are different.

14. A method for coupling a fuel injector to a fuel rail of a combustion engine, comprising the steps of:

coupling a fuel injector cup having a central longitudinal axis to the fuel rail at a first axial end area and to a ring element at a second axial end area by a circlip, wherein the fuel injector cup comprises at least two slots being arranged at the second axial end area and at least two grooves of the fuel injector cup being arranged at least partly circumferentially the fuel injector cup and axially overlapping with the slots, arranging the ring element at the central longitudinal axis facing the second axial end area of the fuel injector cup and coupling the ring element to a housing of the fuel injector, wherein the ring element comprises at least two protrusions facing the fuel injector cup and the protrusions comprise at least two grooves of the ring element being arranged at least partly circumferentially the ring element in a common plane with the grooves of the fuel injector cup, and arranging the circlip at least partly circumferentially the fuel injector cup at least partly in the grooves of the fuel injector cup and arranging the circlip at least partly circumferentially the ring element at least partly in the grooves of the ring element.

15. The method according to claim 14, comprising the step of arranging at least one of the ring element and the fuel injector cup at least partly circumferentially the housing of the fuel injector.

16. The method according to claim 14, comprising the step of coupling the ring element by a snap ring to the housing of the fuel injector, the ring element, the housing of the fuel injector and the snap ring being designed and arranged such as to prevent a movement of the housing of the fuel injector relative to the ring element at least in one direction of the central longitudinal axis.

17. The method according to claim 16, comprising the step of arranging the slots of the fuel injector cup and the protrusions of the ring element such that the distances circumferentially the fuel injector cup between at least two of the slots and the distances circumferentially the ring element between at least two of the protrusions are different.

* * * * *